US005376312A

United States Patent [19]

Morton et al.

[11] Patent Number: 5,376,312

[45] Date of Patent: Dec. 27, 1994

[54] RAPID ABSORPTION STEAM HUMIDIFYING SYSTEM

[75] Inventors: Bernard W. Morton, Minnetonka; Kirk A. Nelson, Minneapolis; Ricky D. Balmer, Chanhassen, all of Minn.

[73] Assignee: Dri Steem Humidifier Company, Eden Prairie, Minn.

[21] Appl. No.: 163,309

[22] Filed: Dec. 8, 1993

Related U.S. Application Data

[63] Continuation-in-part of Ser. No. 905,916, Jun. 29, 1992, Pat. No. 5,277,849, which is a continuation-in-part of Ser. No. 687,327, Apr. 18, 1991, Pat. No. 5,126,080.

[51] Int. Cl.[5] ..... B01F 3/04

[52] U.S. Cl. ..... 261/118; 261/DIG. 76; 239/932; 239/554

[58] Field of Search ..... 261/118, DIG. 76; 239/132, 554

[56] References Cited

U.S. PATENT DOCUMENTS

| | | | |
|---|---|---|---|
| 669,558 | 3/1901 | Stoddard | 122/488 |
| 2,010,859 | 8/1935 | Huet | 122/488 |
| 2,040,092 | 5/1936 | Leedy | 285/417 |
| 2,186,125 | 1/1940 | Roberts | 261/DIG. 76 |
| 2,237,417 | 4/1941 | Croft | 183/52 |
| 2,329,000 | 9/1943 | Rembert | 29/88.2 |
| 2,455,180 | 11/1948 | Kennedy | 285/168 |
| 2,945,628 | 7/1960 | Broughton | 239/554 |
| 2,949,239 | 8/1960 | Goyette | 239/120 |
| 3,096,817 | 7/1963 | McKenna | 165/60 |
| 3,134,657 | 5/1964 | Anderson | 55/263 |
| 3,435,593 | 4/1969 | Nordone | 55/84 |
| 3,566,584 | 3/1971 | Ruthrof et al. | 55/345 |
| 3,642,201 | 2/1972 | Potchen | 236/44 |
| 3,724,180 | 4/1973 | Morton et al. | 55/410 |
| 3,778,981 | 12/1973 | Ross | 55/263 |
| 3,857,514 | 12/1974 | Clifton | 239/132 |
| 3,920,423 | 11/1975 | Ross | 55/103 |
| 3,923,483 | 12/1975 | Hilmer et al. | 261/DIG. 76 |
| 4,045,193 | 8/1977 | Halliday | 261/118 |
| 4,265,840 | 5/1981 | Bahler | 261/118 |
| 4,358,341 | 11/1982 | Bergquist | 159/4 B |
| 4,384,873 | 5/1983 | Herr | 55/263 |
| 4,508,551 | 4/1985 | Ruoss et al. | 261/DIG. 76 |
| 4,783,099 | 11/1988 | Muser | 285/7 |
| 4,800,926 | 1/1989 | Beck | 138/106 |
| 4,818,256 | 4/1989 | Ross | 55/93 |
| 4,913,856 | 4/1990 | Morton | 261/116 |
| 5,126,080 | 6/1992 | Morton et al. | 261/116 |

FOREIGN PATENT DOCUMENTS

| | | |
|---|---|---|
| 451261 | 9/1948 | Canada . |
| 663306 | 7/1938 | Germany . |
| 844011 | 7/1952 | Germany . |
| 635416 | 3/1983 | Switzerland . |

OTHER PUBLICATIONS

Dri-Steem® Model STS™ Brochure (Copyright 1987, Dri-Steem® Humidifier Co.).

Dri-Steem® Steam Injection Humidifiers Brochure Copyright 1989, Dri-Steem® Humidifier Co.).

Vaporstream® Electric Steam Humidifiers Brochure (Copyright 1990, Dri-Steem® Humidifier Co.).

*Primary Examiner*—Tim Miles

*Attorney, Agent, or Firm*—Woodcock Washburn Kurtz Mackiewicz & Norris

[57] ABSTRACT

An improved apparatus for introducing steam into an airstream in an HVAC system includes a supply header, steam dispersing structure and structure for collecting condensation from the steam dispersing structure. The supply header is adapted for connection to a source of steam and is preferably elevated with respect to the return header, so that condensation in the supply header and steam dispersing structure is forced into the return header under the influence of steam pressure and gravity. One embodiment of the invention presents a pair of streamlined jackets on one or more of the dispersion tubes that reduce heat loss to the air stream, thereby reducing the amount of condensate that is formed. The jackets are streamlined to minimize turbulence and static pressure loss.

24 Claims, 12 Drawing Sheets

RAPID ABSORPTION STEAM HUMIDIFYING SYSTEM

This is a continuation-in-part of Ser. No. 07/905,916, filed Jun. 29, 1992, now U.S. Pat. No. 5,277,849, which in turn is a continuation-in-part of Ser. No. 07/687,327, filed on Apr. 18, 1991, now U.S. Pat. No. 5,126,080. The disclosures of those two documents and the documents to which they refer are incorporated by reference herein.

BACKGROUND OF THE INVENTION

1. Field of the Invention

This invention relates to humidification systems that are used in heating, ventilating and air conditioning (HVAC) systems. Specifically, this invention relates to improved apparatus for introducing steam into an airstream such a system.

2. Description of the Prior Art

Air that contains an inadequate amount of humidity can cause problems that range in severity from merely annoying to extremely expensive or even life threatening. Dry air can make people more susceptible to colds, sore throats and other respiratory problems. It can draw moisture out of materials such as carpet, wood, paper, leather, vinyls, plastics and foods. It can also contribute to the generation of static electricity, which can damage electronically sensitive tapes and disks.

Most modern commercial and industrial buildings are equipped with steam humidifiers mounted within the heating and air conditioning systems. Steam from a steam boiler or district steam system is introduced into the ducted airstream and distributed throughout the building.

Humidification steam cannot be allowed to condense into water in a duct system. Damp areas in ducts become breeding grounds for algae and bacteria, many of which are disease-producing to humans, contaminating to industrial processes, and so forth.

To prevent condensation in a duct, the steam must be totally absorbed by the air before the air carries the steam into contact with any internal devices such as dampers, fans, turning vanes etc., within the duct. The more thoroughly the steam is mixed with the air, the shorter the distance it will travel within the duct before becoming absorbed by the air.

Some duct configurations, due to structural limitations imposed by the building design, have very limited open space downstream of the humidifier for absorption of the steam. Closely spaced multiple steam humidifier dispersion tubes can provide the degree of mixing of steam and air that is necessary to satisfy most applications of this type. However, steam humidifier dispersion tubes can present two operational difficulties in a closely spaced arrangement. Present day steam dispersion tubes are usually constructed with a hot outer jacket that contains steam. The purpose of the jacket is to keep the tube hot in order to prevent the humidification steam from condensing as it passes through the tube. However, in closely spaced multiple tube arrangements, jacketed tubes can present more air flow resistance within the ducting system than is considered desirable. Even more importantly, jacketed tubes add unwanted heat to the airstream due to the exposed outer surface of the hot jacket, adding an unwanted additional refrigeration load during periods of cooling. This disadvantage becomes especially pronounced in large modern office buildings, where a cooling load frequently exists continuously, even in winter, as result of the building insulation and the considerable heat produced by the occupants and equipment. In such buildings, waste heat from the humidification system is always detrimental.

Insulating the exterior surfaces of the hot jacketing can reduce the heat gain, but further aggravates the air flow resistance problem. An automatic valve can be placed in the steam line supplying steam to the tube jackets and cycling it off and on with the humidifier steam valve. However, the stresses created by the cyclical heating and cooling can cause flexing of the tubes and eventual cracking of the jacket welds.

It is clear there has existed a long and unfilled need in the prior art for a steam injection humidification system that is unaffected by condensation problems, and that is capable of introducing humidity into an airstream consistently and effectively, with a minimum of air flow resistance and a minimum of sensible heat transferred to the airstream.

SUMMARY OF THE INVENTION

Accordingly, it is an object of this invention to provide a steam injection humidifier that is largely unaffected by condensation problems.

It is further an object of this invention to provide a steam injection humidification system that is more consistent in introducing humidity into an airstream than those which are heretofore known.

It is yet further an object of the invention to provide a steam injection humidifier which accomplishes improved performance while eliminating the attendant problems of resistance to air flow and unwanted heat gain to the airstream.

It is also an object of the invention to provide an injection-type steam humidification system which provides improved mixing action of steam and air over those systems which are presently known.

It is an object of this invention to substantially eliminate spitting small drops of water from the steam injection humidifier.

It is another object of this invention to provide a steam injection humidifier which is adaptable to different sizes of the air duct.

It is yet another object of this invention to provide a steam injection humidification system which can be easily disassembled and assembled at an installation site.

In order to achieve these and other objects of the invention, an apparatus for introducing steam to an stream in an HVAC humidification system, includes, according to a first aspect of the invention, at least one tube having a first inlet end that is adapted to be connected to a source of steam; a second outlet end that is adapted to be connected to a liquid and steam collecting structure; an inner surface; an outer surface having first and second axially oriented portions; and a plurality of radial holes defined therein, the holes terminating at the second portion of the outer surface of the tube, but not at the first portion; plurality of nozzles inserted, respectively, in the radial holes, the nozzles each having a bore therein for conducting steam from the tube into an air stream; a first jacket mounted to the tube, the first jacket having an inner surface that defines, together with the first portion of the outer surface of the tube, a substantially closed dead-air space about the first portion of the outer surface of the tube for preventing conductive or convective heat transfer from occurring between the first portion of the outer surface of the tube and the air stream, whereby the amount of condensate that is formed in the tube as a result of heat loss from the tube to the airstream is reduced, and the unwanted cooling load that results from such heat loss is kept to a minimum.

According to another aspect of the invention, an apparatus for introducing steam into an airstream in an HVAC humidification system includes a supply header that is adapted for connection to a source of steam; a condensate drain for draining condensate away from the apparatus; a plurality of steam dispersion tubes, each of the dispersion tubes including a first inlet end that is communicated with the supply header; a second outlet end that is communicated with the condensate drain; an inner surface; an outer surface having first and second axially oriented portions; and a plurality of radial holes defined therein, the holes terminating at the second portion of the outer surface of the tube, but not at the first portion; a plurality of nozzles inserted, respectively, in the radial holes of the tubes, the nozzles each having a bore therein for conducting steam from the respective tube into an air stream; a first jacket mounted to a least one of the tubes, the first jacket having an inner surface that defines, together with the first portion of the outer surface of the at least one tube, a substantially closed dead-air space about the first portion of the outer surface of the at least one tube for preventing conductive or convective heat transfer from occurring between the first portion of the outer surface of the at least one tube and the air stream, whereby the amount of condensate that is formed in the at least one tube as a result of heat loss from the tube to the airstream is reduced, and the unwanted cooling load that results from such heat loss is kept to a minimum.

According to another aspect of the invention, an apparatus for introducing steam to an air stream in an HVAC humidification system includes a tube having a first inlet end that is adapted to be connected to a source of steam; a second outlet end that is adapted to be connected to a liquid and steam collecting structure; an inner surface; an outer surface having first, second and third axially oriented portions; and a plurality of radial holes defined therein, the holes terminating at the second portion of the outer surface of the tube, but not at the first portion of the third portion; a plurality of nozzles inserted, respectively, in the radial holes, the nozzles each having a bore therein for conducting steam from the tube into an air stream; a first jacket mounted to the tube, the first jacket being positioned to prevent air in the airstream from flowing over the first portion of the outer surface of the tube; a second jacket mounted to the tube, the first jacket being positioned to prevent air in the airstream from flowing over the third portion of the outer surface of the tube; and insulation positioned between the tube and the first jacket, and between the tube and the second jacket for preventing heat conduction from the tube to the first and second jackets, whereby the amount of condensate that is formed in the tube as a result of heat loss from the tube to the airstream is reduced, and the unwanted cooling load that results from such heat loss is kept to a minimum.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 1:
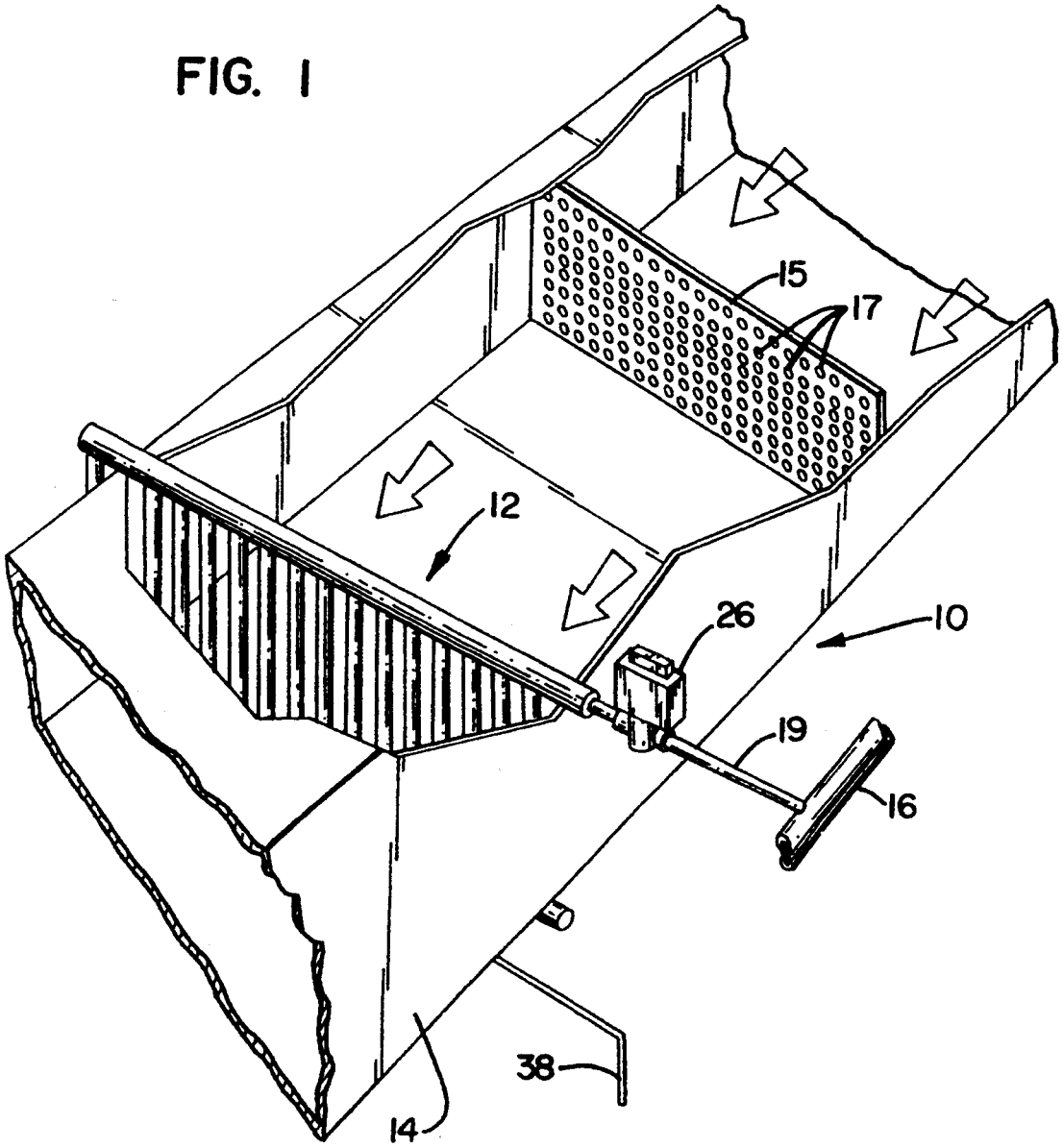
FIG. 1 is a fragmentary perspective view of an HVAC humidification system constructed according to a preferred embodiment of the invention.

Referring now to the drawings, wherein like reference numerals designate corresponding structure throughout the views, and referring in particular to FIG. 1, an improved HVAC humidification system includes a multiple tube dispersion unit 12 that is secured so as to be partially within an HVAC duct 14. A steam supply line 16 is provided from an external source, such as an in-house boiler or district steam system.

Referring again to FIG. 1, the direction of air flow within duct 14 is indicated by the arrows. To provide improved, consistent mixing action of steam and air, a perforated diffuser plate is positioned in duct 14 slightly upstream from the multiple tube dispersion unit 12. In the preferred embodiment, diffuser plate 15 is a flat plate containing a plurality of evenly spaced perforations or holes 17. In operation, pressure builds up on the upstream side of diffuser plate 15. The constant pressure allows air to escape through each of the evenly spaced holes 17 at a common flow rate. Since holes 17 are spaced evenly over the surface of diffuser plate 15, the air flow immediately upstream of dispersion unit 12 is thus constrained to be substantially even and constant over the entire cross section of duct 14. As a result, an even steam-to-air mixing takes place at the plane within duct 14 at which dispersion unit 12 is located.

Figure 2:
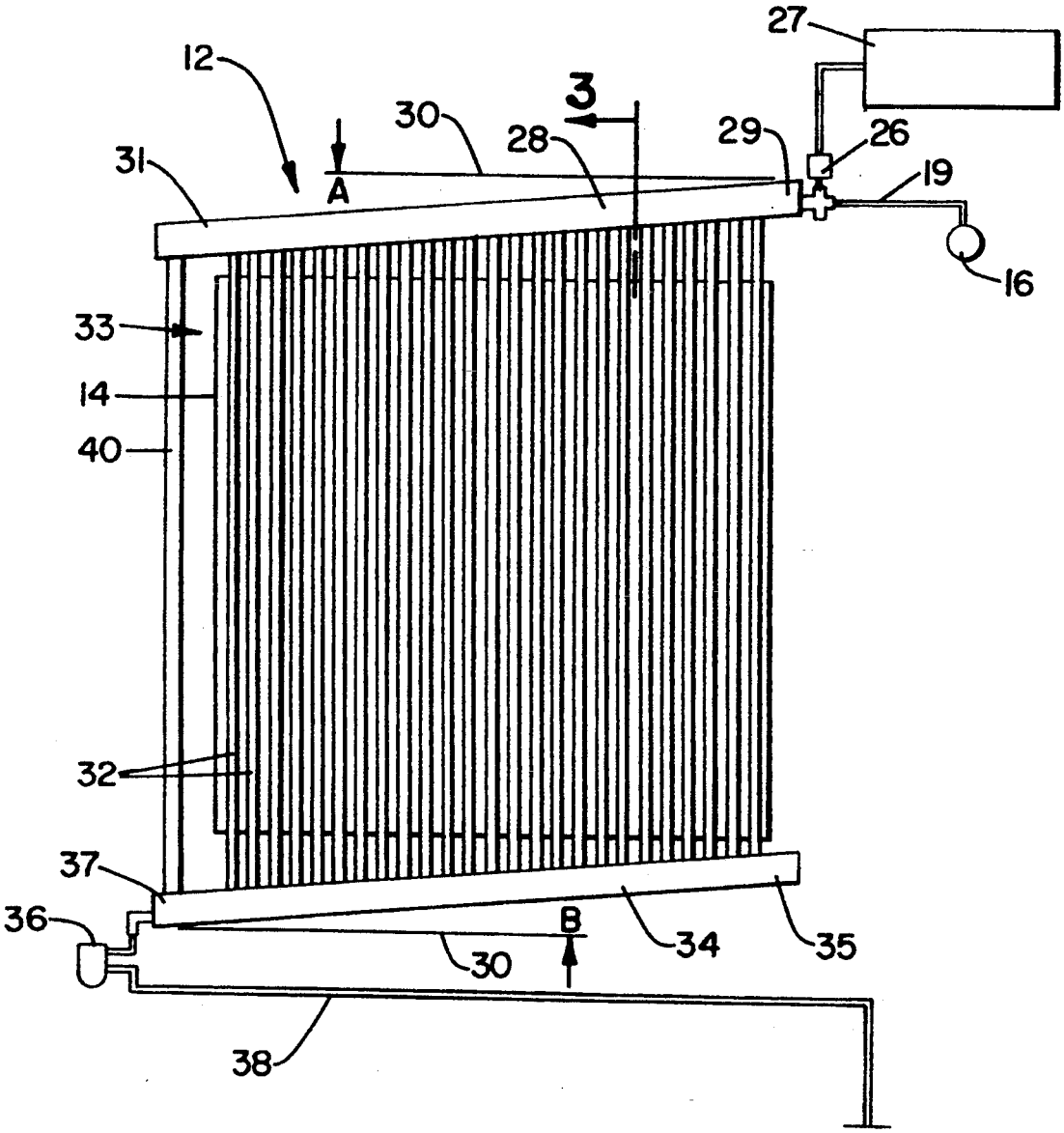
FIG. 2 is a partially schematic diagram depicting a portion of the system illustrated in FIG. 1.

Referring now to FIG. 2, steam from supply line 16 is supplied to dispersion unit 12 via a steam line 19. A control valve 26 is interposed in steam dispersion line 19 for regulating the amount of steam that is allowed to flow into dispersion unit 12. A control system 27, the details of which will be known to those skilled in the art, is arranged so as to selectively open or close control valve 26.

Referring again to FIG. 2, dispersion unit 12 includes a longitudinally extending supply header 28 which is connected at a first end 29 to steam line 19. The first end 29 of supply header 28 is elevated with respect to a second, opposite end 31. As a result, the longitudinal axis of supply header 28 is inclined with respect to a horizontal plane 30 at an angle A, as may be seen in FIG. 2. As a result, any condensation which forms within supply header 28 is caused to drain toward second end 31. It should be understood that header 28 could be vertical if tilted at a different angle to achieve the same effect.

Dispersion unit 12 includes a steam dispersion portion 33 that is constructed of a plurality of elongate tubes 32. In the preferred embodiment, the tubes 32 are mounted so that their longitudinal axes are substantially vertical and parallel to each other. Alternatively, however, they could be tilted at another, lesser angle with respect to the horizontal, as long as the second end position is beneath first end portion 42. Each of the tubes 32 are connected at a first end portion 42 to supply header 28, and at a second end portion to a return header 34. The preferred construction of tubes 32 will be described in greater detail below.

As may be seen in FIG. 2, return header 34 extends longitudinally between a first end 35 and a second, opposite end 37. First end 35 is elevated with respect to second end 37. As a result, the longitudinal axis of return header 34 is inclined with respect to a horizontal plane 30 by an angle B, as is shown in FIG. 2. Angle A is preferably the same or greater than Angle B. Condensation in return header thus tends to flow toward second end 37 and into a steam trapping device which in the preferred embodiment is a stranded steam trap 36 which is of the type which is well known in the art which is connected to second end 37. A drain line 38 is provided to conduct condensate from steam trap 36, as may be seen in FIG. 2.

Looking again to FIG. 2, a condensation drain line 40 is provided to guide condensed water from the second end 31 of supply header 28 to the second end 37 of return header 34, and thus into steam trap 36.

Figure 3:
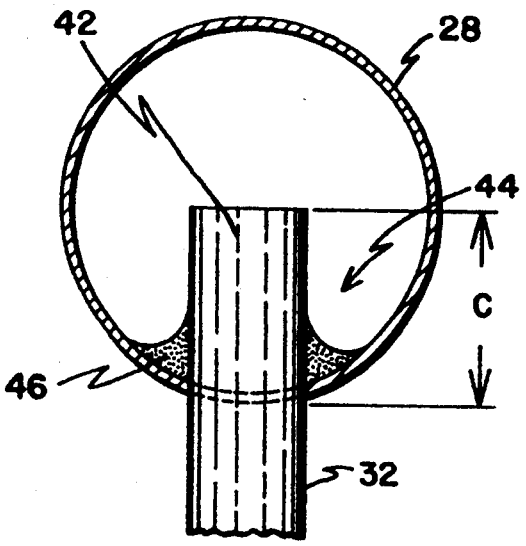
FIG. 3 is a fragmentary cross-sectional view taken along 3—3 in FIG. 2.

Referring now to FIG. 3, the first end portion 42 of each of the tubes 32 extends through an outer wall of supply header 28 for some distance into a space which is defined within the supply header 28. Preferably, supply header 28 is circular in cross-section, and the first end portion 42 terminates in a plane which contains the longitudinal axis of supply header 28, as is shown in FIG. 3. Since first end portion 42 extends for some distance into the supply header 28, a collection space 44 is formed in a lower half of supply header 28 in which condensation may collect. As a result, the condensation is prevented from entering the tubes 32. The collected condensation 46 is shown in FIG. 3. Condensation 46 will flow toward the second end 31 of supply header 28 due to the inclination of supply header 28, and into the condensation drain line 40 as has previously been described.

Figure 4:
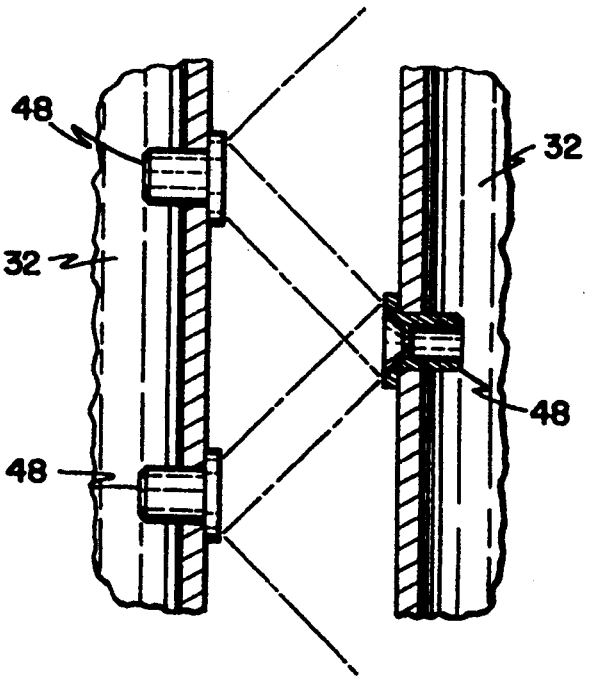
FIG. 4 is an enlarged fragmentary cross-sectional view taken along lines 4—4 in FIG. 2.
Figure 5:
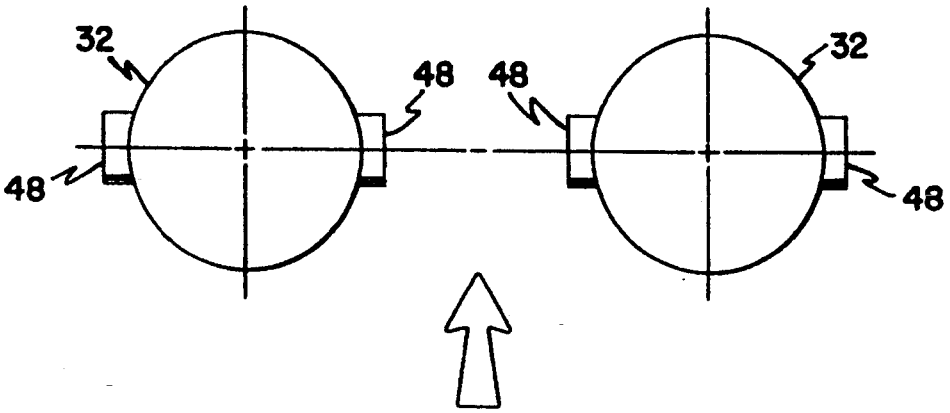
FIG. 5 is a diagrammatical view depicting a feature of the embodiment shown in FIGS. 1–4.

As may be seen in FIG. 4, a plurality of vapor nozzles 48 are mounted within holes defined radially in the outer wall of each of the tubes 32. Each of the vapor nozzles 48 have an orifice defined therein for allowing a predetermined flow rate of vapor to pass therethrough at a given input pressure. In a first embodiment which is shown in FIG. 5, nozzles 48 are positioned with respect to the respective tubes 32 so that the bores therein are substantially aligned along a plane which contains the longitudinal axes of the parallel tubes 32. The direction of the air flow is shown in FIG. 5 by an arrow.

As shown in FIG. 4, the nozzles 48 protrude well inwardly of the inside cylindrical surface, preferably to the center, of the respective tubes 32. As a result, the condensation that forms and will naturally adhere to the inside surfaces of tubes 32 will drain downwardly along the inside surface and into the return header 34, rather than being expelled into the airstream through the nozzle 48. This feature of the invention, in conjunction with the structure that is described above with regard to FIG. 3, ensures that condensation is efficiently drained from the unit rather than escaping into the airstream that is to be humidified.

Figure 6:
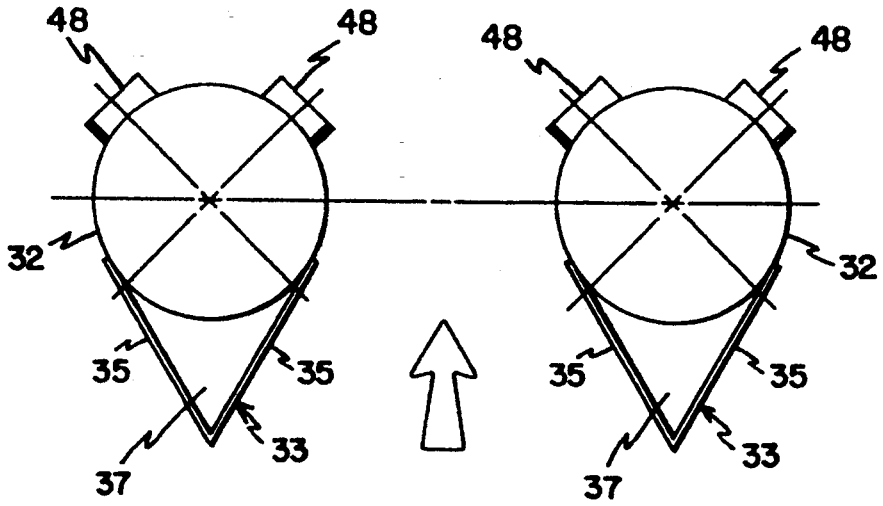
FIG. 6 is a diagrammatical view which corresponds to the view of FIG. 5 and depicts a second embodiment of one aspect of the invention.

In a second embodiment which is illustrated in FIG. 6, the nozzles 48 are located so that their axial bores are positioned at an acute angle with respect to the plane which contains the longitudinal axes of the tubes 32. The nozzles 48 are positioned on the side of the tubes 32, which is downstream from the direction of the air flow, as it is indicated by the arrow in FIG. 6. Preferably, the nozzles 48 on each of the tubes 32 are symmetrical with respect to the direction of the air flow, which in FIG. 6 is substantially perpendicular to the plane containing the longitudinal axes of tubes 32. In practice, the embodiment shown in FIG. 5 is better suited for use in systems having a relatively high velocity air flow. Conversely, the embodiment shown in FIG. 6 is better suited for use in systems having a lower air flow velocity.

Another important feature of the embodiment of the invention which is illustrated in FIG. 6 is the provision of wedge-shaped fenders 33 on the upstream side of each of the tubes 32. In the embodiment which is illustrated in FIG. 6, each fender 33 is formed by a pair of plates 35 which are joined to each other at a first end, and are fastened to opposite sides of a tube 32 on a second end thereof. The plates 35 thus create a dead air space 37 which provides insulation against heat transfer between the airstream and the tube 32. As a result, a dispersion tube 32 having a fender 33 mounted thereon will transmit less heat to the airstream than it would without the fender 33, while still being able to inject steam into the airstream through nozzles 48. A secondary benefit of the diminished heat transfer between tubes 32 and the airstream with the provision of fenders 33 is that less condensation will occur within the tubes 32, thereby improving the overall efficiency of the system. The fenders 33 also serve to streamline the cross-section of the tube relative to the direction of air flow, thus decreasing air flow resistance. Although the fenders 33 are illustrated only with respect to the embodiment of the invention which is shown in FIG. 6, it is to be understood that such fenders could likewise be used in the embodiment shown in FIG. 5, or in other, equivalent embodiments according to the spirit of the invention.

Figure 7:
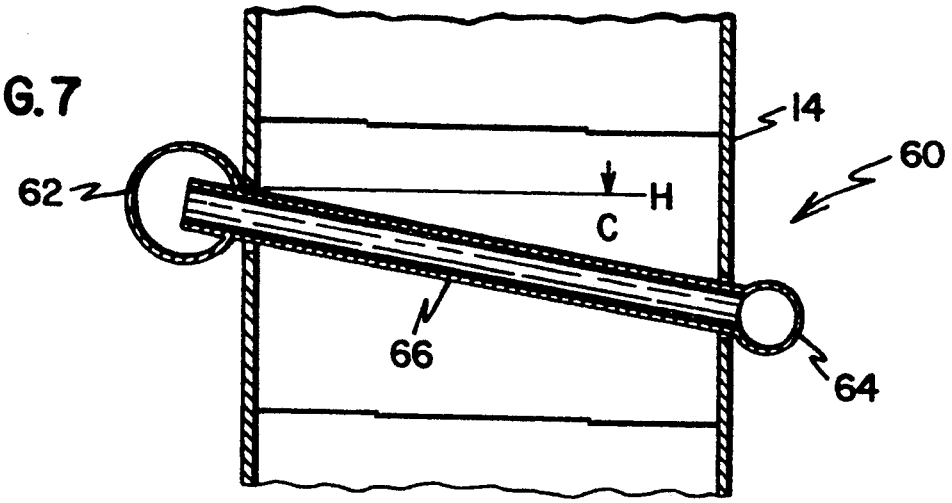
FIG. 7 is a fragmentary cross-sectional view of a second embodiment of a second aspect of the invention.

Referring now to FIG. 7, a second embodiment 60 of an improved HVAC humidification system includes a supplier header 62 and a return header 64 which are mounted externally of a vertically-extending HVAC duct 14. As may be seen in FIG. 7, return header 64 is positioned at a level that is beneath the level at which supplier header 62 is positioned. As a result, the plurality of elongate steam dispersion tubes 66 which extend between supply header 62 and return header 64 are inclined with respect to a horizontal plane H at an angle C. As a result, condensation within the elongate tube 66 is caused to run downwardly into the return header 64, which is connected to a drain pipe in the manner shown in FIG. 2. Preferably, supply header 62 and return header 64 are both slightly inclined with respect to the horizontal plane H, so that condensation therein can be collected and drained in the manner that is shown and described with respect to FIG. 2. The system illustrated in FIG. 7 is identical in all other aspects to that shown in FIGS. 1–5.

Figure 8:
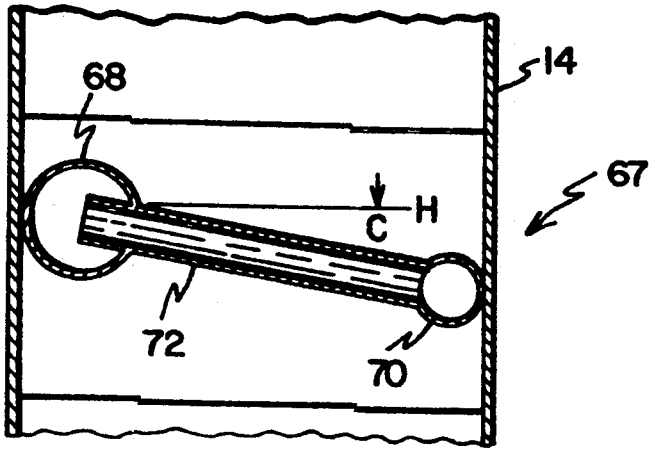
FIG. 8 is a fragmentary cross-sectional view of a third embodiment of the second aspect of the invention.

Looking now to FIG. 8, an improved HVAC humidification system 67 constructed according to a third embodiment of the invention includes a supply header 68 and a return header 70, both of which are positioned within a vertically-extending duct 14. An elongate tube 72 extends from supply header 68 to return header 70. Supply header 68 is elevated with respect to return header 70, and elongate tube 72 thus is inclined with respect to a horizontal plane H at an angle C. The system 67 illustrated in FIG. 8 is identical in all other respects to the system 60 which has previously been shown and described with respect to FIG. 7. Generally, the system illustrated in FIG. 7 is preferable for use in vertically-extending ducts wherein sufficient external space is available to accommodate supply header 62 and 30 return header 64.

Figure 10:
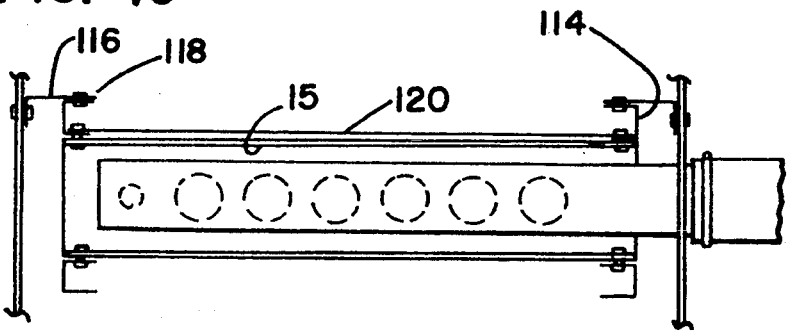
FIG. 10 is a fragmentary top plan view of the embodiment depicted in FIG. 9.
Figure 9:
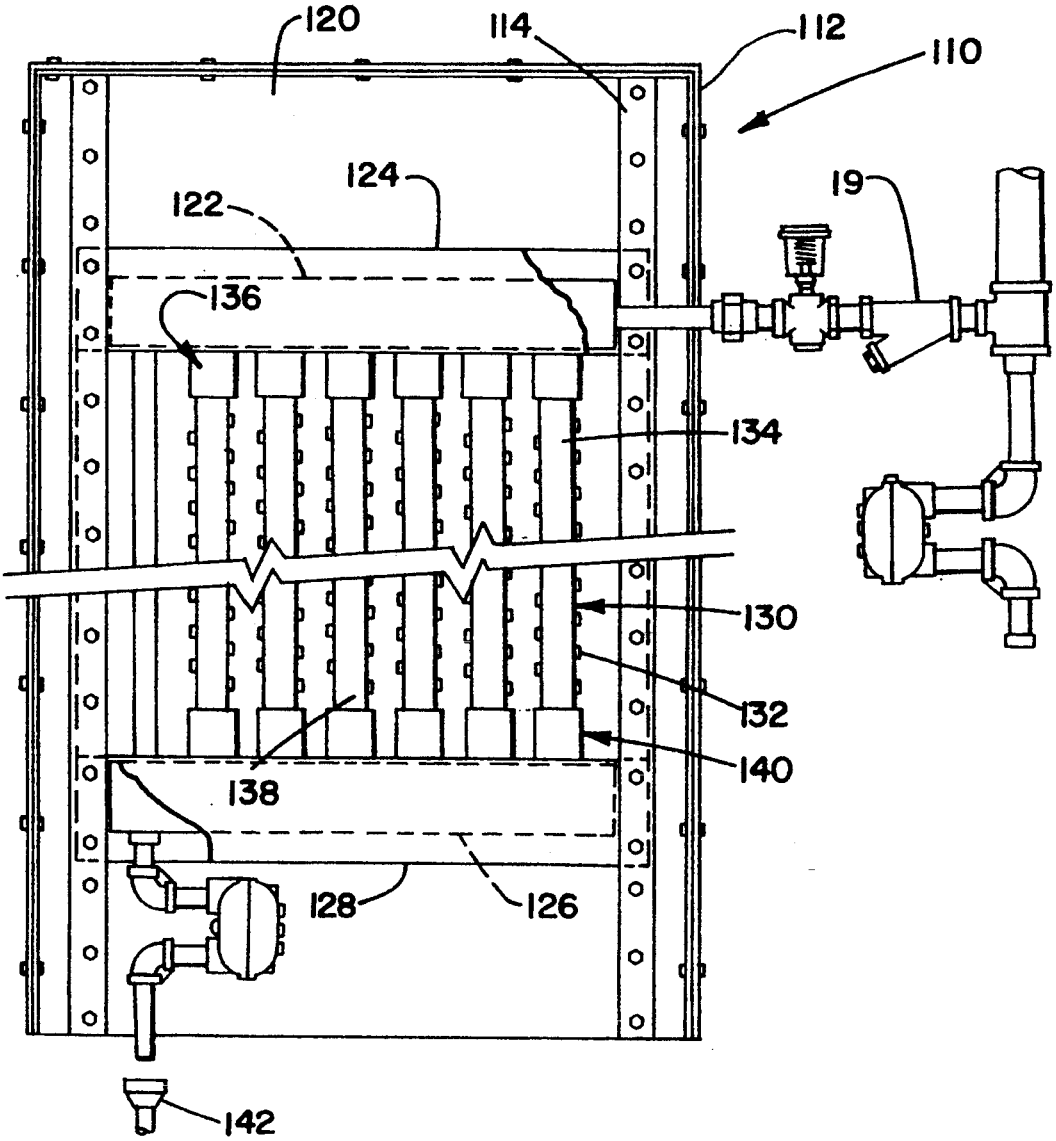
FIG. 9 is a fragmentary view of a system constructed according to a fourth preferred embodiment of the invention.

A system constructed according to a fourth preferred embodiment of the invention is illustrated in FIGS. 9–14. Referring first to FIGS. 9 and 10, system 110 is adapted for connection to a source 19 of steam and for positioning within an air stream in an HVAC humidification system, such as within an air handler casing 112. As is shown in FIGS. 9 and 10, system 110 is mounted to the air handler casing 112 by a pair of mounting channels 114, which are riveted or bolted to the system 110 on one leg thereof and to a respective pair of side blank off plates 116 on a second leg thereof. The respective side blank off plates 116 are in turn mounted to the air handler casing 112. Similarly, top and bottom blank off plates 120 are bolted or riveted to the respective mounting channels 114 to prevent the air stream within air handler casing 112 to by-pass the system 110. Through such a mounting arrangement 118, a system 110 constructed according to standardized dimensions may be mounted with positive humidification results in ducts such as air handler casing 112 of many different sizes. In other words, it is more economical to customize the size of the blank off plates 116, 120 than it would be to customize the dimensions of the system 110 for a particular application. A second advantage created by blank-off plates 116, 120 is that, by limiting the cross-section of air flow, they raise the velocity of air passing through the system 110.

Referring again to FIG. 9, it will be seen that a supply header 122 of the system 110 is enclosed within an header enclosure 124. Similarly, a return header 126 is enclosed within a header enclosure 128. Header enclosures 124, 128 prevent or greatly reduce direct heat transfer between the respective headers 122, 126 to the air stream, which could result in the formation of unwanted condensation within the headers 122, 126.

Except as specifically described herein, system 110 is identical in its construction to that described with reference 10 the embodiment of FIGS. 1–8.

A plurality of steam dispersion tubes 130 are mounted to the supply header 122 at first inlet ends 134 thereof and to return header 126 at second outlet ends 138 thereof. A plurality of nozzles 132 are fitted within radial bores 154 which are defined in the respective steam dispersion tubes 130. The specific construction of steam dispersion tubes 130 and nozzles 132 will be described in greater detail below.

Figure 15:
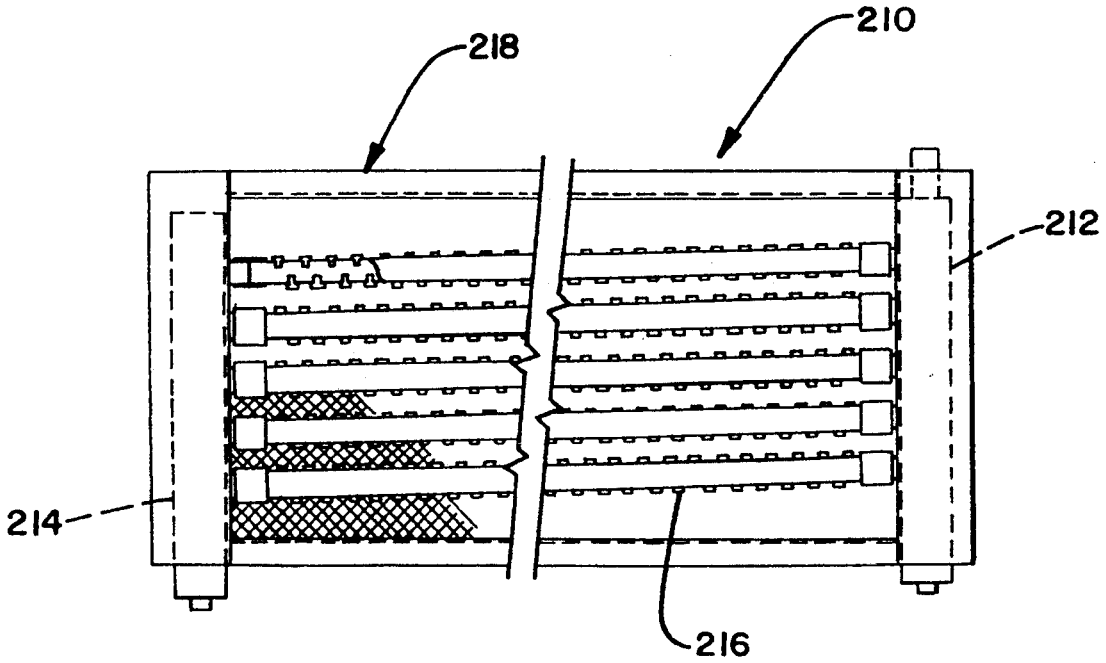
FIG. 15 is a diagrammatic view of a system according to the invention positioned in a second type of orientation with respect to a duct.

As described above with reference to the first embodiment, system 110 is not necessarily mounted so that dispersion tubes 130 are vertically positioned, as shown in FIG. 9. Rather, the system could be positioned so that tubes 130 are positioned at another, lesser angle with respect to the horizontal, as long second outlet ends 138 are positioned at least a slight distance beneath first inlet ends 134. For example, FIG. 15 depicts a system 210 wherein the supply and return headers 212, 214 are positioned vertically, while steam dispersion tubes 216 are positioned with a very slight downward incline from the supply header to the return header. Such a system 210 would typically include a mounting frame 218 which is adopted to mount the unit to a duct that is larger in the horizontal direction than the vertical direction.

According to one important aspect of the invention, System 110 is constructed so that the steam dispersion tubes 130 can be quickly and efficiently decoupled from the supply header 122 and the return header 126. This feature allows the tubes 130 to be quickly removed from the system 110 for cleaning, repair or replacement. Perhaps even more importantly, it allows the system 110 to be quickly and efficiently broken down into its components for compact shipping and handling prior to installation at the desired site.

Figure 11:
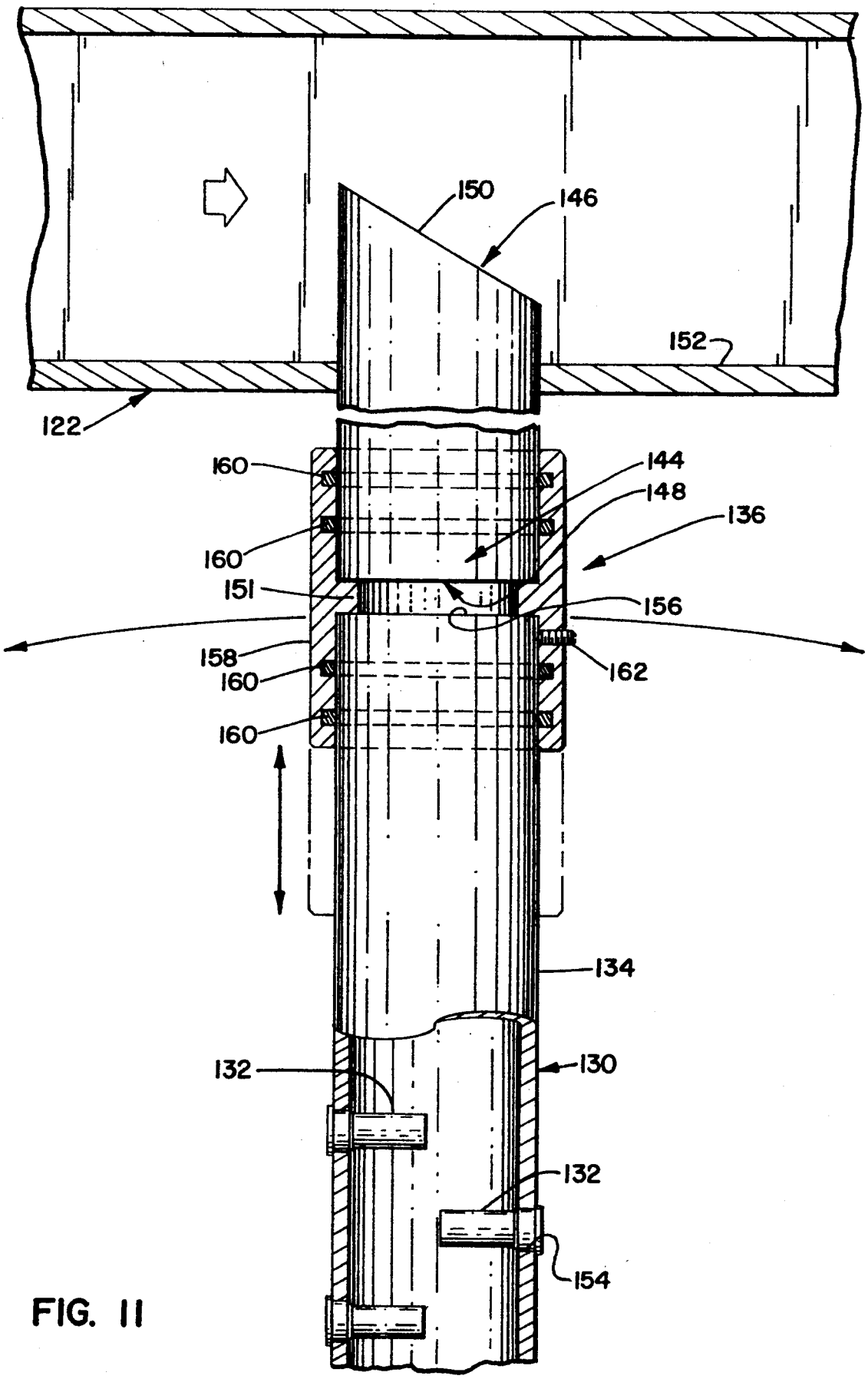
FIG. 11 is a fragmentary cross-sectional view depicting operation of a first quick disconnect arrangement in the embodiment of the invention depicted in FIGS. 9 and 10.

Referring now to FIG. 11, a first quick disconnect arrangement 136 between supply header 122 and a first inlet end 134 of a steam dispersion tube 130 includes a tube nipple 144 which is fixedly mounted by welding or an alternative method to supply header 122. Tube nipple 144 includes a first end orifice 146 defined in a bevelled end surface 150 and positioned centrally within the space defined by an inner surface 152 of the supply header 122. Besides the advantages which are discussed above with reference to the embodiment depicted in FIG. 3, the bevelled end surface 150 of tube nipple 144, being angled away from the direction of steam flow within the supply header 122, tends to intercept entrained moisture in the steam before the steam flows into orifice 146.

Tube nipple 144 is preferably of the same outer diameter as the steam dispersion tube 130, and has a second end surface 148 which is perpendicular to the longitudinal axis of the tube nipple 144. The first inlet end 134 of tube 130 has an end surface 156 which is positionable a spaced distance with respect to the second end surface 148 of tube nipple 144, as may be seen in FIG. 11. A collar member 158 which has an inner diameter slightly greater than the outer diameters of tube nipple 144 and tube 130 is positioned about the lower end of tube nipple 144 and the first inlet end 134 of tube 130. One or more set screws 162 may be provided within the collar member 158 to secure the collar member 158 to the tube 130, the tube nipple 144 or both. Two or more O-rings 160 or an equivalent sealing structure are provided within grooves defined in the inner surface of the collar member 158 to seal the inner surface of the collar member 158 about the respective outer surfaces of tube nipple 144 and tube 130. In the preferred embodiment, two O-rings are provided to seal against the tube nipple 144, and two O-rings 160 are provided to seal about the first inlet end 144 of tube 130.

Collar member 158 includes an internal shoulder 151 which is positioned to space the respective end surfaced 148, 156 apart. The purpose of shoulder 151 is to keep the collar member 158 from sliding down the tube 130 while deployed in a system 110.

Preferably, collar member 158 is fabricated from a material which can adequately withstand the temperatures created by the passage of steam through the system 110, and has good thermal insulation properties. In the preferred embodiment, collar member 158 is fabricated from a high temperature plastic, which is used most preferably polyphenlyene sulfide (PPS). Alternatively, other materials which are noncorrosive, humidity and heat resistant could be used.

Figure 12:
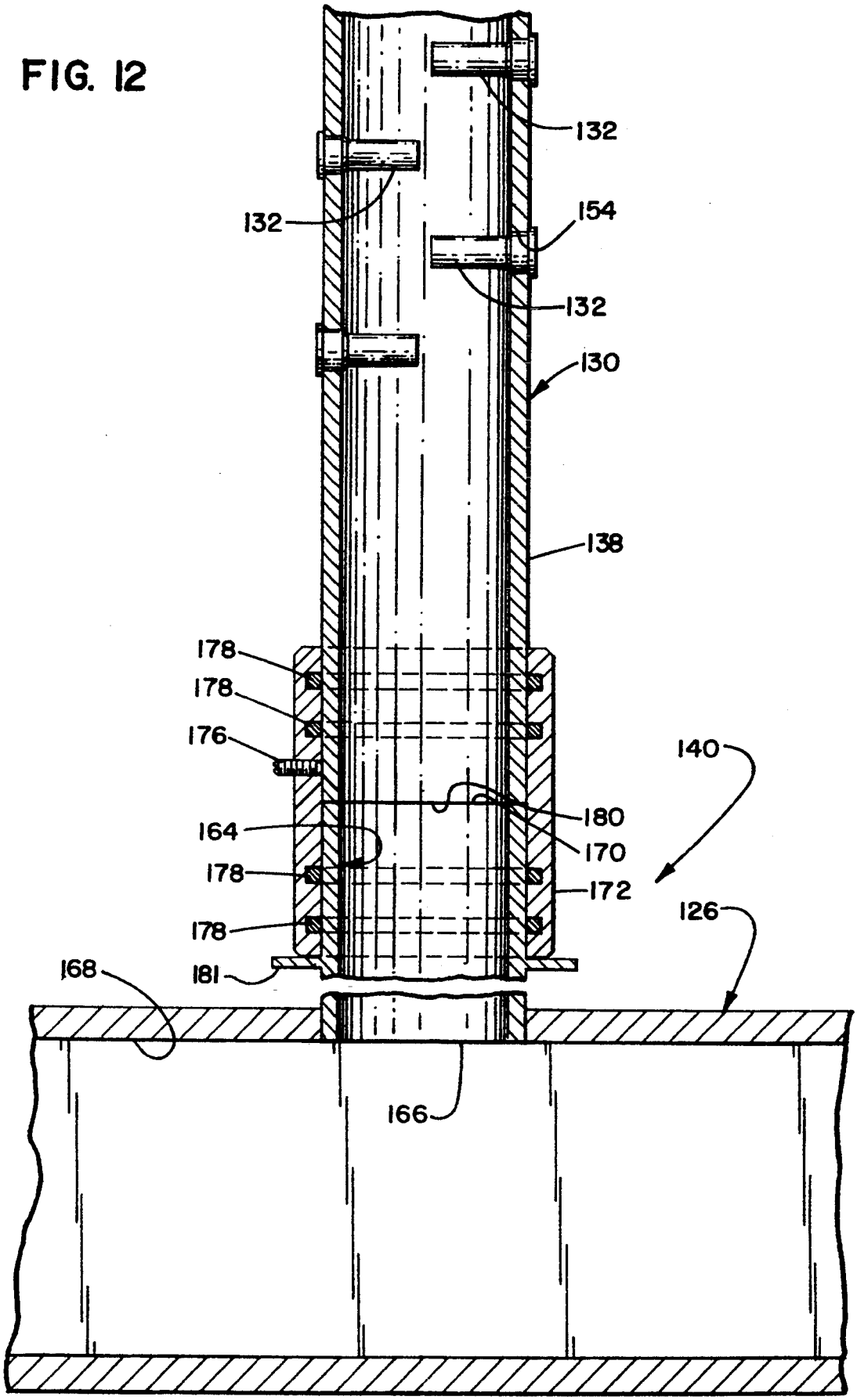
FIG. 12 is fragmentary cross-sectional view depicting operation of a second quick disconnect coupling in the embodiment depicted in FIG. 9–11.

Referring now to FIG. 12, a second quick disconnect coupling 140 is provided to releasably couple the second outlet 138 of each tube member 130 to the return header 126. Return header 126 includes a tube nipple 164 which has a first end 166 welded or otherwise mounted to return header 126 in such a manner that first end 166 is substantially flush with the inner surface 168 of return header 126. A second end surface 170 of tube nipple 164 is substantially perpendicular to the axis of tube nipple 164. Second outlet end 138 of steam dispersion tube 130 includes an end surface 180 which is perpendicular to the axis of tube 130 and is preferably positioned adjacent to the end surface 170 of tube nipple 164. A collar member 172 is sealingly fitted about the adjacent end surfaces of the tube 130 and tube nipple 164. O-rings 178 are positioned within grooves defined within the internal cylindrical surface of collar member 172 to effect such sealing with respect to the tube 130 and tube nipple 164, as may clearly be seen in FIG. 12. A set screw 176 is provided in collar member 172 to secure collar member 172 to the second outlet end 138 of tube 130. Additional set screws may be provided to secure collar member 172 to tube nipple 164 as well. Lower collar member 172 is fabricated, preferably, from the same material as collar member 158. A stop ring 181 is mounted on a lower end of tube nipple 164 to limit downward movement of the collar member 172 on tube nipple 164.

To install a tube 130 into the system 110, the first inlet end 134 of steam dispersion tube 130 is fitted into the lower end of first collar member 158, and the second collar member 172 is slided over the second outlet end 138 of tube member 130. The assembly consisting of tube member 130, first collar member 158 and second collar member 172 is then positioned with respect to tube nipple 144 so that tube nipple 144 is slided into the open upper end of first collar member 158. Once the second end surface 148 of tube nipple 144 contacts the internal shoulder 151 of first collar member 158, the lower outlet end 138 of tube 130 is aligned with respect to the tube nipple 164. At this point, second collar member 172 is slided downwardly against stop ring 181, so that the lower pair of O-rings 178 seal about the outer circumferential surface of tube nipple 164. The upper pair of O-rings 178 in collar member 172 will continue to seal against the outer circumferential surface of the lower, outlet end 138 of tube 130. Set screws 176, 162 may be tightened at this point.

To disassemble tube 130 from the system 110, the above described process is reversed. First, set screws 176, 162 are loosened. Then, second collar member 172 is slided upwardly, and the lower, outlet end 138 of tube member 130 is displaced laterally. Then, tube member 130 is pulled downwardly, disengaging the upper inlet end 134 of tube member 130 and the associated collar member 158 from the tube nipple 144.

It should be understood that set screws 162, 176 are optional, and that the system 110 could just as preferably could be constructed without such set screws.

Figure 13:
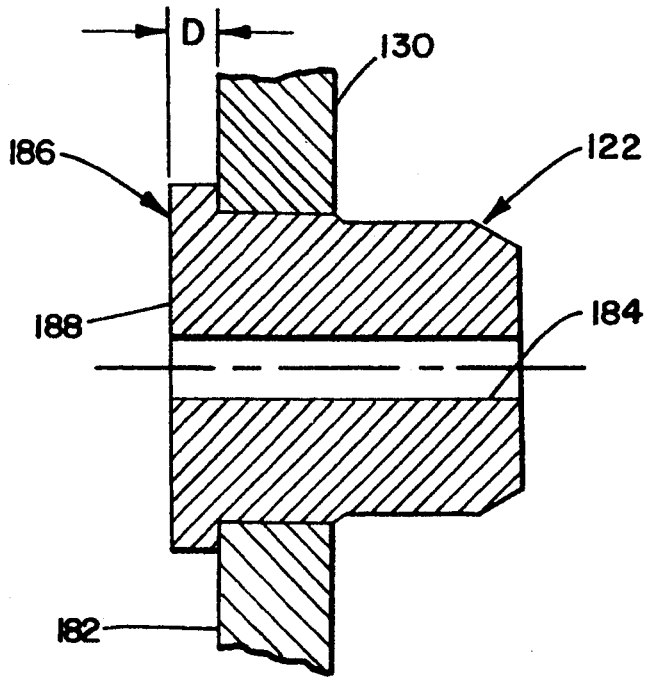
FIG. 13 is a fragmentary cross-sectional view of a first preferred embodiment of a nozzle in the embodiment of FIGS. 9–12.
Figure 14:
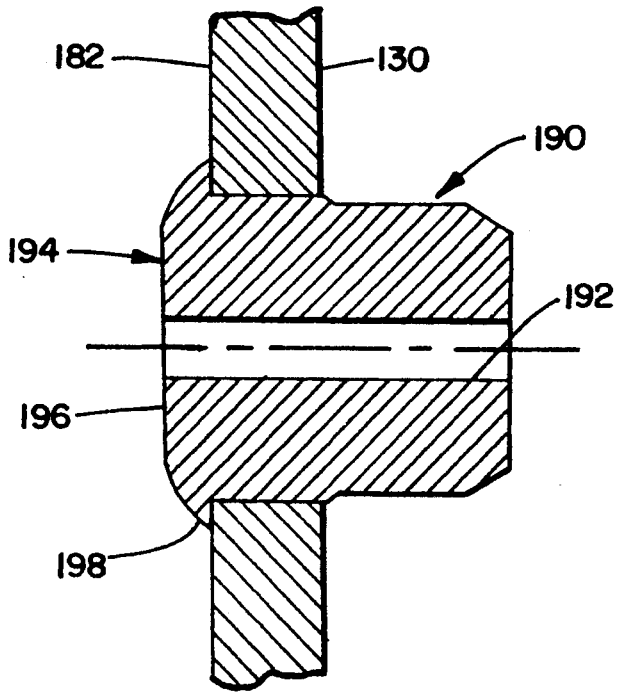
FIG. 14 is a fragmentary cross-sectional view of a second preferred nozzle embodiment for the system depicted in FIGS. 9–12.

FIGS. 13 and 14 depict alternative embodiments of the nozzles 132, 190 which may be inserted within the radial bores 154 that are defined in steam dispersion tube 130. One important characteristic of both nozzles 132, 190 is that both include flat, uninterrupted surfaces 188, 196, respectively, on the end thereof which is exposed to the air stream. Flat surfaces 188, 196 prevent the formation of fluid drops on the outer surface of nozzles 132, 190, as may have been formed with previous nozzle embodiments that incorporated a recessed outer nozzle surface.

Nozzle 132, depicted in FIG. 13, includes an internal bore which permits passage of humidification steam from within the steam dispersion tube 130 to the air stream. An outer portion 186 of nozzle 132 includes a flange which precisely positions nozzle 132 with respect to the outer wall of tube 130. Outer portion 186 of nozzle 132 is constructed so as to minimize the distance by which nozzle 132 protrudes into the air stream. Preferably, outer portion 186 protrudes a distance D from the outer surface 182 of dispersion tube 130 which is equal to or less than 0.05 inches.

Referring to FIG. 14, nozzle 190 differs from nozzle 132 in that the edges of its outer portion 194 include tapered edge portions 198. Tapered edge portion 198 is constructed so as to taper or feather down to the outer surface 182 of dispersion tube 130. This reduces the resistance that system 110 creates to airflow, and can also tend to reduce heat transfer between the air stream and the steam dispersion tube 130. Preferably, nozzles 132, 190 are fabricated from a thermoplastic resin which has low thermal conductivity, and which can withstand the heat stresses created by steam flow through the system 110. Preferably, this material is polyphenlyene sulfide.

Figure 16:
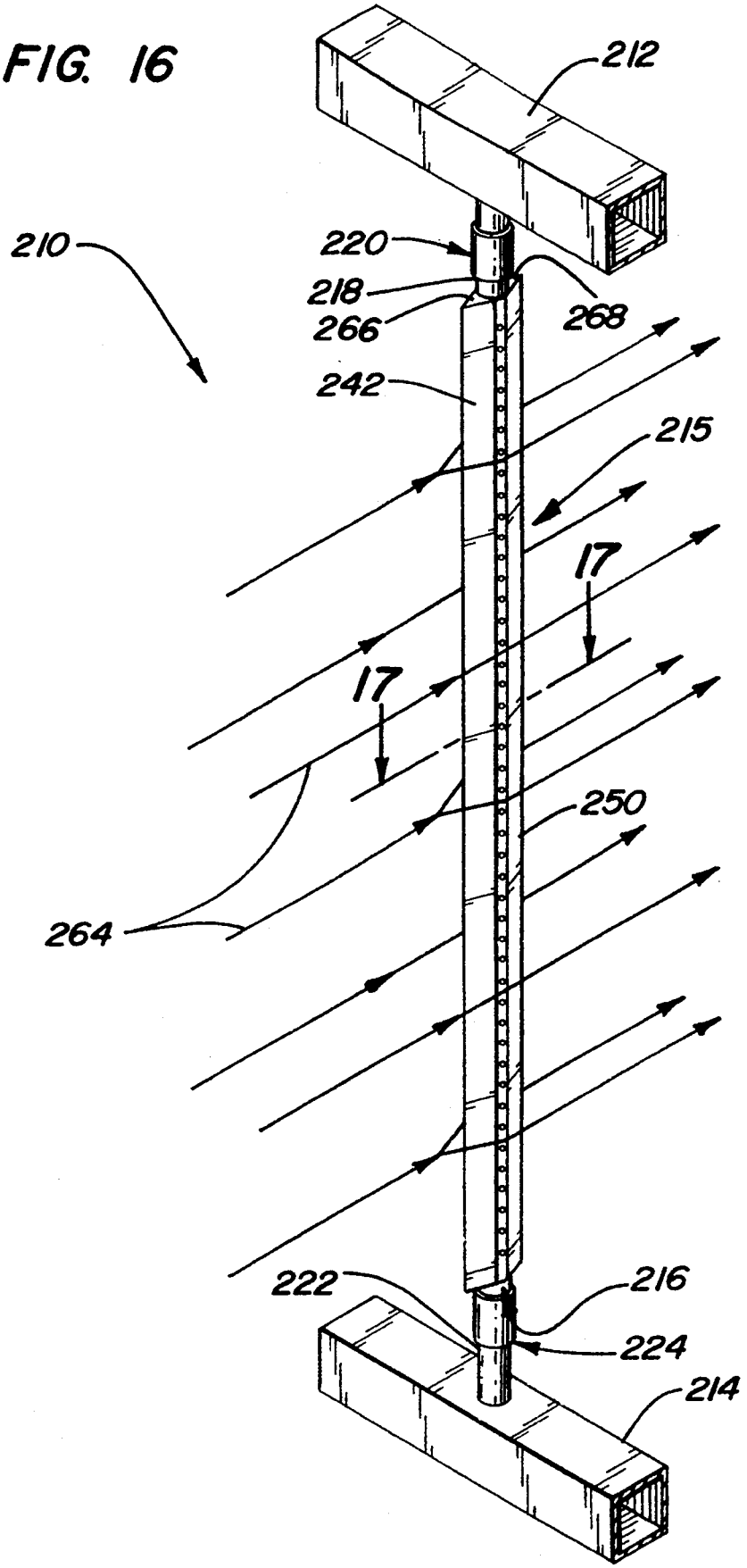
FIG. 16 is a fragmentary perspective view of an alternative embodiment for the steam dispersion tubes depicted in the foregoing figures.
Figure 17:
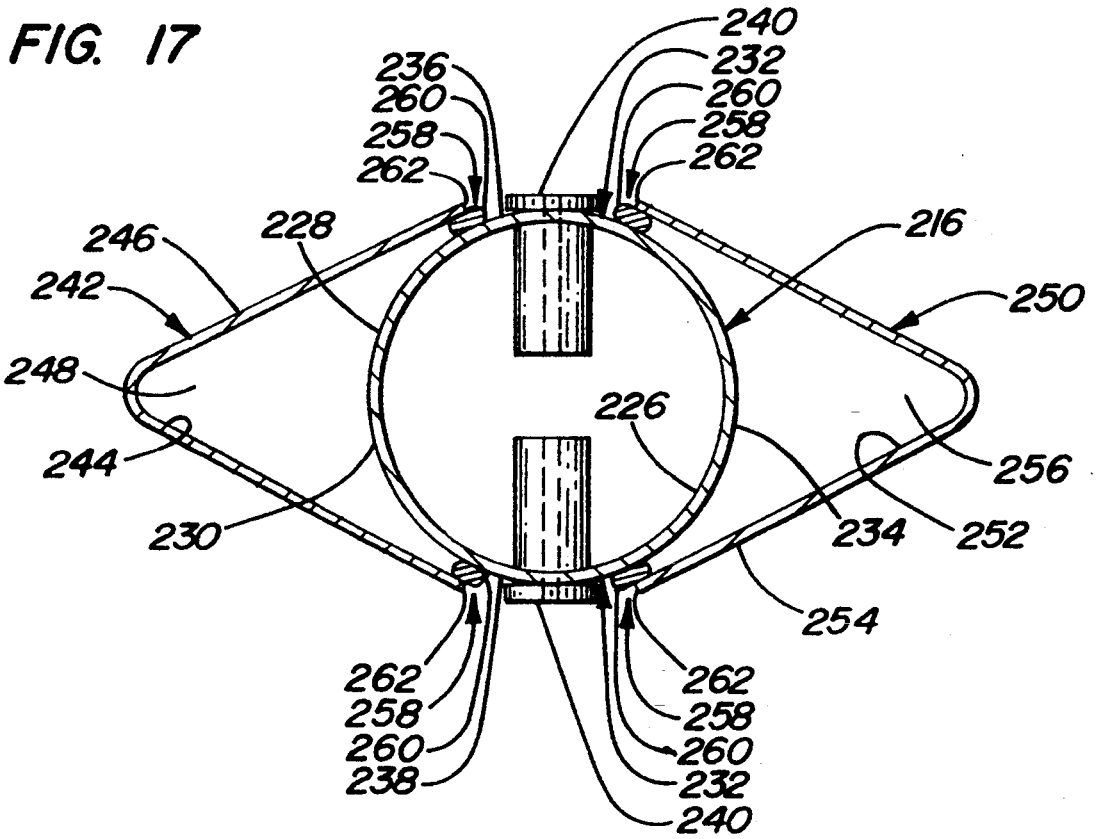
FIG. 17 is a cross-sectional view through a steam dispersion tube that is constructed according to the embodiment shown in FIG. 16.

Another embodiment of the invention is illustrated in FIGS. 16 and 17. In this embodiment, an apparatus 210 for introducing steam to an air stream 264 in an HVAC humidification system includes, as in the previous embodiments, a supply header 212 and a return header 214. Apparatus 210 further includes a novel dispersion tube assembly 215 that includes at least one dispersion tube 216 having a first inlet end 218 that is adapted to be connected to supply header 212 or an alternative source of steam such as by a slip coupling 220, as is illustrated in FIG. 16. Dispersion tube 216 further has a second, outlet end 222 that is adapted to be connected to a liquid and steam collecting structure, such as the return header 214 by means of slip coupling 224, also depicted in FIG. 16. It is to be understood that dispersion tube assembly 215 could be used in lieu of the dispersion tubes that have been disclosed above in reference to any of the previously described embodiments. Most preferably, dispersion tube assembly 215 is intended to be used in a system such as the one that is depicted in previously described FIG. 9.

Referring now to FIG. 17, it will be seen that dispersion tube 216 includes an inner surface 226 and an outer surface 228. The outer surface 228 of dispersion tube 216, for purposes of describing the structure of dispersion tube assembly 215, can be set to include a first axially extending portion 230, a second axially extending portion 232 and a third axially extending portion 234. The second axially extending portion 232 is separated into first and second side portions 236, 238. By using the descriptive terms "axially extending" or "axially oriented," it is meant that first, second and third portions 230, 232, 234 of outer surface 228 are each elongated in the direction of the central axis of tube 216 to an extent that is greater than their respective width along the circumference of the outer surface 228 of dispersion tube 216, as it is viewed in FIG. 17.

A plurality of radial holes are defined in dispersion tubes 216, as may be seen in FIGS. 16 and 17. Those holes terminate at the second portion 232 of outer surface 228, but not at first portion 230 or third portion 234. More specifically, in the preferred embodiment, some of the radial holes terminate at the first side 236 of second portion 232, while other of the holes terminate at the second side 238 of second portion 232. Each of the radial holes has a nozzle 240 inserted therein, in the manner that is described with respect to the embodiment of FIG. 9. Each nozzle has a bore defined therein for conducting steam from tube 216 into the air stream 264, in the manner that is described in detail with respect to the previously described embodiments.

Referring again to FIGS. 16 and 17, a first jacket 242 is mounted to dispersion tube 216 by one or more fasteners, the details of which are unimportant except that those fasteners preferably should not conduct heat in any great amount. First jacket 242 is preferably fabricated from a durable metallic material, most preferably stainless steel. First jacket 242 is preferably streamlined with respect to the air stream 264 in order to minimize static pressure loss and turbulence. In the preferred embodiment, first jacket 242 is substantially v-shaped, and has a substantially v-shaped inner surface 244 and a substantially v-shaped outer surface 246. The substantially v-shaped inner surface 244 defines, together with the first portion 230 of the outer surface 228 of dispersion tube 216, a substantially closed dead air space 248 about the first portion 230 of dispersion tube 216. This space 244 is sealed off even at the ends of first jacket 242 by a pair of end panels 266, as may be seen in FIG. 16. Dead air space 248 prevents conductive or convective heat transfer from occurring between the first portion 230 of the outer surface 228 of dispersion tube 216 and the air stream 264. By reducing the heat loss from the dispersion tube 216 during operation, formation of condensate on the inner surface 226 of dispersion tube 216 is lessened, and less waste heat is permitted to escape into the air stream 264. The reduction in the amount of heat that is transferred to the air stream 264 is particularly advantageous for large modern office buildings, many of which have a year-round cooling load; there is never a time where the excess heat becomes an advantage rather than a disadvantage.

According to the preferred embodiment, dispersion tube assembly 215 further includes a second streamlined, v-shaped jacket 250 that is mounted to an opposite side of dispersion tube 216 from the first jacket 242. The second jacket 250 includes a v-shaped inner surface 252 and a substantially v-shaped outer surface 254. The inner surface 252 of second jacket 250, along with the third portion 234 of the outer surface 228 of dispersion tube 216, as well as a pair of end panels 268 define a substantially closed dead air space 256 about the third portion 234 of the outer surface 228 of dispersion tube 216. The function of second jacket 250 is identical to that of first jacket 242 in that it prevents conductive or convective heat transfer from occurring between the portion of the outer surface 228 it covers and the air stream 264.

To prevent direct heat transfer between the outer surface 228 of dispersion tube 216 and the first and second jackets 242, 250, insulation 258 is provided between each jacket 242, 250 and the outer surface 228 of dispersion tube. As may be seen in FIG. 17, the insulation 258 includes a strip 260 of insulating material that is interposed between each edge 262 of the first and second jackets 242, 250 and the outer surface 228 of dispersion tube 216. Strips 260 are each preferably fabricated from a fire resistant non-metallic material that has low thermal conductivity. Most preferably, strips 260 are fabricated from a high temperature fireproof thermoplastic.

Alternatively, in lieu of the insulation 258, the first and second jackets 242, 250 could be fabricated from a non-metallic material that has a low thermal conductivity. For example, a composite material or fiberglass could be used. It is particularly important, though, that the material for both the jackets 242, 248 be fireproof, so as to avoid fire risk within the ventilation system of the building in which apparatus 210 is installed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extend indicated by the broad general meaning of the terms in which the appended claims are expressed.

What is claimed is:

1. An apparatus for introducing steam to an air stream in an HVAC humidification system, comprising:

at least one tube having a first inlet end that is adapted to be connected to a source of steam; a second outlet end that is adapted to be connected to a liquid and steam collecting structure; an inner surface; an outer surface having first and second axially oriented portions; and a plurality of radial holes defined therein, the holes terminating at the second portion of the outer surface of the tube, but not at the first portion;

a plurality of nozzles inserted, respectively, in said radial holes, said nozzles each having a bore therein for conducting steam from said tube into an air stream;

a first jacket mounted to said tube, said first jacket having an inner surface that defines, together with said first portion of said outer surface of said tube, a dead-air space about said first portion of said outer surface of said tube for preventing conductive or convective heat transfer from occurring between said first portion of said outer surface of said tube and the air stream, whereby the amount of condensate that is formed in said tube as a result of heat loss from said tube to the airstream is reduced, and the unwanted cooling load that results from such heat loss is kept to a minimum.

2. An apparatus according to claim 1, further comprising insulation means positioned between said tube and said first jacket for preventing heat conduction from said tube to said first jacket.

3. An apparatus according to claim 2, wherein said insulation means comprises a fire-resistant non-metallic strip that is positioned between an edge of said first jacket and said tube.

4. An apparatus according to claim 2, wherein said insulation means comprises a pair of fire-resistant non-metallic strips that are positioned, respectively, between two opposite edges of said first jacket and said tube.

5. An apparatus according to claim 3, wherein said strip comprises a high-temperature fireproof thermoplastic.

6. An apparatus according to claim 1, wherein said first jacket is streamlined to reduce to minimize resistance to the airstream.

7. An apparatus according to claim 6, wherein said first jacket is substantially V-shaped.

8. An apparatus according to claim 1, wherein said jacket is fabricated from a metallic material.

9. An apparatus according to claim 8, wherein said jacket is fabricated from stainless steel.

10. An apparatus according to claim 1, wherein said outer surface of said tube comprises a third portion, opposite said first portion, at which none of said radial holes terminate, and said apparatus further comprises a second jacket mounted to said tube, said second jacket having an inner surface that defines, together with said third portion of said outer surface of said tube, a dead-air space about said third portion of said outer surface of said tube for preventing conductive or convective heat transfer from occurring between said third portion of said outer surface of said tube and the air stream, whereby formation of condensate within said tube is further reduced.

11. An apparatus for introducing steam into an airstream in an HVAC humidification system, comprising:

a supply header that is adapted for connection to a source of steam;

condensate draining means for draining condensate away from said apparatus;

a plurality of steam dispersion tubes, each of said dispersion tubes comprising:

a first inlet end that is communicated with said supply header;

a second outlet end that is communicated with said condensate draining means;

an inner surface;

an outer surface having first and second axially oriented portions; and a plurality of radial holes defined therein, said holes terminating at said second portion of said outer surface of said tube, but not at said first portion;

a plurality of nozzles inserted, respectively, in said radial holes of said tubes, said nozzles each having a bore therein for conducting steam from said respective tube into an air stream;

a first jacket mounted to a least one of said tubes, said first jacket having an inner surface that defines, together with said first portion of said outer surface of said at least one tube, a dead-air space about said first portion of said outer surface of said at least one tube for preventing conductive or convective heat transfer from occurring between said first portion of said outer surface of said at least one tube and the air stream, whereby the amount of condensate that is formed in said at least one tube as a result of heat loss from said tube to the airstream is reduced, and the unwanted cooling load that results from such heat loss is kept to a minimum.

12. An apparatus according to claim 11, further comprising insulation means positioned between said at least one tube and said first jacket for preventing heat conduction from said tube to said first jacket.

13. An apparatus according to claim 12, wherein said insulation means comprises a fire-resistant non-metallic strip that is positioned between an edge of said first jacket and said at least one tube.

14. An apparatus according to claim 12, wherein said insulation means comprises a pair of fire-resistant non-metallic strips that are positioned, respectively, between two opposite edges of said first jacket and said at least one tube.

15. An apparatus according to claim 13, wherein said strip comprises a high-temperature fireproof thermoplastic.

16. An apparatus according to claim 11, wherein said first jacket is streamlined to reduce to minimize resistance to the airstream.

17. An apparatus according to claim 16, wherein said first jacket is substantially V-shaped.

18. An apparatus according to claim 11, wherein said jacket is fabricated from a metallic material.

19. An apparatus according to claim 18, wherein said jacket is fabricated from stainless steel.

20. An apparatus according to claim 11, wherein said outer surface of said at least one tube comprises a third portion, opposite said first portion, at which none of said radial holes terminate, and said apparatus further comprises a second jacket mounted to said at least one tube, said second jacket having an inner surface that defines, together with said third portion of said outer surface of said at least one tube, a substantially closed dead-air space about said third portion of said outer surface of said at least one tube for preventing conductive or convective heat transfer from occurring between said third portion of said outer surface of said at least one tube and the air stream, whereby formation of condensate within said at least one tube is further reduced.

21. An apparatus for introducing steam to an air stream in an HVAC humidification system, comprising:

a tube having a first inlet end that is adapted to be connected to a source of steam; a second outlet end that is adapted to be connected to a liquid and steam collecting structure; an inner surface; an outer surface having first, second and third axially oriented portions; and a plurality of radial holes defined therein, said holes terminating at said second portion of said outer surface of said tube, but not at said first portion or said third portion;

a plurality of nozzles inserted, respectively, in said radial holes, said nozzles each having a bore therein for conducting steam from said tube into an air stream;

a first jacket mounted to said tube, said first jacket being positioned to prevent air in the airstream from flowing over said first portion of said outer surface of said tube;

a second jacket mounted to said tube, said first jacket being positioned to prevent air in the airstream from flowing over said third portion of said outer surface of said tube; and insulation means positioned between said tube and said first jacket, and between said tube and said second jacket for preventing heat conduction from said tube to said first and second jackets, whereby the amount of condensate that is formed in said tube as a result of heat loss from said tube to the airstream is reduced, and the unwanted cooling load that results from such heat loss is kept to a minimum.

22. An apparatus for introducing steam to an air system in an HVAC humidification system, comprising:

a supply header that is constructed and arranged to be connected to a source of steam, said supply header having a first end and a second end, said first end being elevated with respect to said second end, whereby condensation therein will flow toward said second end;

a plurality of dispersion tubes connected to said supply header for receiving steam from said supply header, each of said dispersion tubes having at least one hole defined therein for dispersing steam so received into an airstream;

means at said second end of said supply header for draining collected condensate from said supply header; and a frame connected to said supply header and said dispersion tubes for mounting said apparatus within a duct in an HVAC system, whereby said apparatus can be installed quickly and conveniently as a unit in an existing HVAC system.

23. An apparatus according to claim 22, wherein said supply header includes an outer wall having an inner surface that defines an interior space; and said dispersion tubes extend through said outer wall for a distance into said interior space, whereby condensate on said inner surface is prevented from entering said dispersion tubes.

24. An apparatus according to claim 22, wherein said supply header and said dispersion tubes are oriented with respect to said frame so that said supply header is substantially vertical and said dispersion tubes are substantially horizontal.

* * * * *